US005356043A

United States Patent [19]

Glynn

[11] Patent Number: 5,356,043

[45] Date of Patent: Oct. 18, 1994

[54] CHILD RESISTANT CAP WITH SAFETY COLLAR FOR SPRAYERS

[75] Inventor: Kenneth P. Glynn, Hunterdon County, Raritan Township, N.J.

[73] Assignee: Ideal Ideas, Inc., Flemington, N.J.

[21] Appl. No.: 113,237

[22] Filed: Aug. 30, 1993

[51] Int. Cl.[5] ..... B67B 5/00

[52] U.S. Cl. ..... 222/153; 222/402.11

[58] Field of Search ..... 222/402.13, 153, 182, 222/402.11; 220/27, 54, 85 P; 215/246

[56] References Cited

U.S. PATENT DOCUMENTS

| | | | |
|---|---|---|---|
| 3,703,974 | 11/1972 | Boxer et al. . | |
| 3,782,578 | 1/1974 | Ballin . | |
| 3,884,393 | 5/1975 | Wassilieff | 222/402.11 X |
| 4,095,718 | 6/1978 | Kong . | |
| 4,315,576 | 2/1982 | Murphy et al. | 222/153 X |
| 4,361,243 | 11/1982 | Virtanen . | |
| 4,424,919 | 1/1984 | Knox et al. | 222/153 |
| 4,589,573 | 5/1986 | Tada | 222/153 |
| 4,620,646 | 11/1986 | Crasper | 222/153 |
| 4,735,346 | 4/1988 | Stoody | 222/153 |
| 4,830,224 | 5/1989 | Brison | 222/153 |
| 4,848,595 | 7/1989 | Foster et al. | 222/153 |
| 5,141,129 | 8/1992 | Jennings | 222/153 X |
| 5,238,152 | 8/1993 | Maas et al. | 222/153 |

*Primary Examiner*—Andres Kashnikow
*Assistant Examiner*—Kenneth DeRosa
*Attorney, Agent, or Firm*—Kenneth P. Glynn

[57] ABSTRACT

The present invention is a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizonal track thereon for attachment to the track of the base so as to connect them in such a way as to be horizontally and freely rotatable thereabout. The outer ring has a top with an inwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

14 Claims, 1 Drawing Sheet

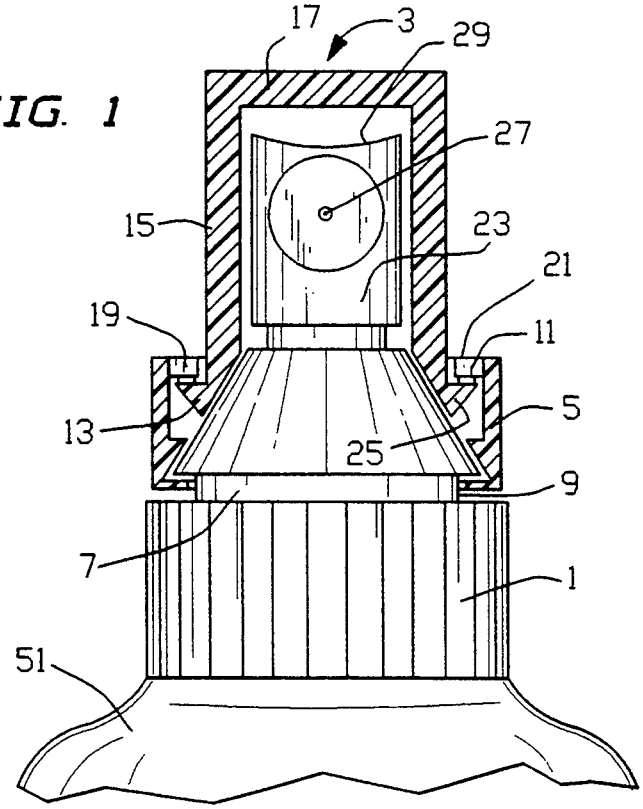
FIG. 1
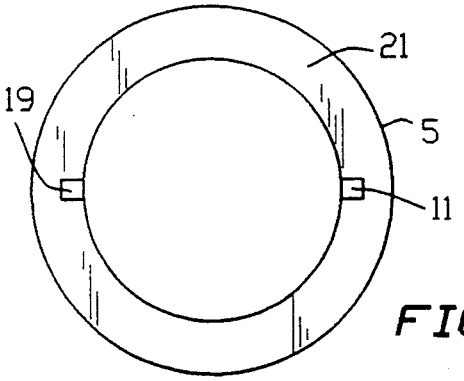
FIG. 2
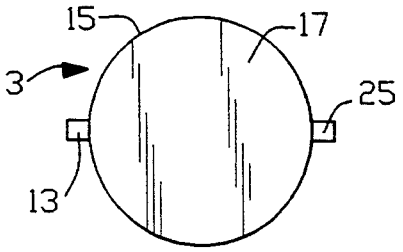
FIG. 3
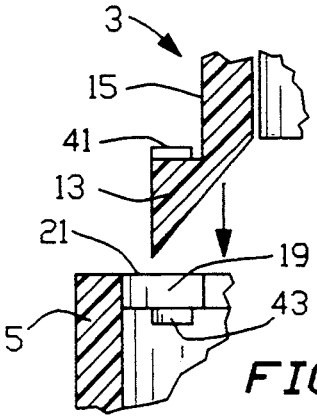
FIG. 4
FIG. 5
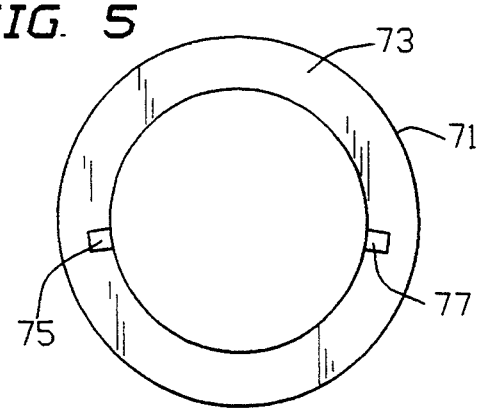

CHILD RESISTANT CAP WITH SAFETY COLLAR FOR SPRAYERS

BACKGROUND OF THE INVENTION

Field of the Invention

The present invention relates to child resistant caps, and more particularly to caps with safety collars for sprayers. By sprayers is meant spray containers having atomizers, pumps, pressurized contents with release valves, and other spray dispensing mechanisms.

Information Disclosure Statement

Safety caps have been well known for at least three decades and literally come in many hundreds of shapes and forms with diverse mechanisms for achieving safety. The objective of such devices is to slow down or prevent the opening of a dispenser by a child to ultimately reduce or prevent use of a medication or dangerous or hazardous material by a young child who may unwittingly consume some of the contents and suffer severe consequences. The following patents represent four variations on safety caps which exemplify the art:

U.S. Pat. No. 3,703,974 to Leo Boxer and Robert Boxer describes a safety cap and container combination wherein the container mouth includes a plurality of spaced ribs or flanges, each having a differently located, notched out passageway over which a cap member having at least one projecting internal lug is positioned in a single movement to close the container. In one form of the invention, a bead at the rim of the container mouth may be provided to mate with an internal groove in the cap member to seal tightly the cap member to the container. In order to remove the cap member, it is moved partially away from the container to disengage the bead from the groove and the lug member is then positioned and aligned with each slot and advanced therethrough in successive fashion to open the mouth of the container.

U.S. Pat. No. 3,782,578 to Gene Ballin sets forth a novel disposable closure. The device includes an opener for opening a closure cap along a score line around the base of an annular channel without piercing the cap. It includes a collar which rotatably and slidably engages the cap and includes a peripheral wall provided with circumferentially spaced depending arcuate teeth of greater thickness than the channel and stop elements which limit the downward movement of the device on the cap. The device is pressed downwardly and rotated so that the teeth wedge between and spread the channel walls to sever the closure along the full length of the score line. The piercing of the channel by the teeth is prevented by the stop elements.

U.S. Pat. No. 4,095,718 to Cheung Tung Kong describes a convertible safety cap. A cap is provided for closing a container having a locking portion for use in a precautionary arrangement to prevent children from obtaining access into the container. The cap is convertible so as to cooperate with such a container to provide not only such a precautionary arrangement but also an alternative easy opening arrangement. The invention includes a cap, an annular disk and a locking rim with notches through which tabs on the cap may pass.

U.S. Pat. No. 4,361,243 to Risto Virtinen describes a closing means for a container, tube or the like. This device is a closing means for a nozzle which is fixably mounting on a container or for a tube or the like. The closing means is openable when turned into a predetermined position which is indicated by indicators provided on the closing means and on the container. It is settable diametrically opposite to each other, and characterized in that the lower rim of the closing means or the upper rim of the container is provided with a separate background ring extending at least partially behind the indicator of the closing means and the indicator of the container.

Notwithstanding the significant prior art in this field, it is believed that the present invention, which utilizes a safety collar (outer ring) in the particular fashion described herein, is neither taught nor rendered obvious.

SUMMARY OF THE INVENTION

The present invention is a spray dispenser device closure. It includes a main closure base for attachment to a container, an outer ring, a spray mechanism attached to the base and an overcap. The main closure base has a top portion with a circular horizontal track thereon for attachment with an outer ring. The outer ring has a circular inside wall with a horizonal track thereon for attachment to the track of the base so as to connect them in such a way as to be freely horizontally rotatable thereabout, but otherwise permanently connected to one another. The outer ring has a top with an inwardly biased ledge for retaining an overcap and has at least one cut out on the ledge to permit an overcap to be inserted and removed from the outer ring. The spray mechanism is attached to the top of the base and extends therethrough for insertion into a container. The overcap has a circular bottom adapted to be inserted into the outer ring and over the spray mechanism. The bottom of the overcap has at least one protrusion which has a geometry of adequate size to freely move through the cut out of the ledge of the outer ring. When the overcap is inserted and rotated, it can not be removed unless the protrusion is aligned with the cut out. In preferred embodiments, the ledge of the outer ring has adequate flexibility to allow the overcap to be pushed down without alignment of the protrusion and the cut out, but not to be removed unless alignment is first provided.

BRIEF DESCRIPTION OF THE DRAWINGS

The present invention will be more fully understood when the specification herein is taken in conjunction with the drawings appended hereto, wherein:

FIG. 1 shows a partial front partially cut view of a present invention spray dispenser device closure;

FIG. 2 shows a top view of an outer ring used in the closure shown in FIG. 1;

FIG. 3 shows a top view of the overcap used in the closure shown in FIG. 1;

FIG. 4 shows a partial cut side view of a portion of an overcap and outer ring illustrating details of the closure shown in FIG. 1; and, FIG. 5 shows a top view of an alternative embodiment outer ring for a present invention closure.

DETAILED DESCRIPTION OF THE INVENTION

FIG. 1 shows a front partially cut, partial view of a present invention spray dispenser device closure. Here, main closure base 1 is shown attached to container 51. This is attached by known conventional means and may include crimping, heat sealing, force fitting, irreversible threading or any other known attachment means. Overcap 3 is shown in its cut view along with outer ring 5.

Main closure base 1 includes a base track 7. In this case, it is a horizontal, circular indentation, as shown. Alternatively, it could be an annular protrusion or bead. Outer ring 5 has a track catch 9 which, in this case, is a protrusion which fits into base track 7 and allows outer ring 5 to be freely horizontally rotated about main closure base 1. As an alternative, if base track 7 were a bead protrusion, then outer ring track catch 9 would be an indentation instead of a protrusion. In other words, it is not critical as to whether the base or the outer ring has the male or female portion of the track. In any event, by "track" is meant either an indentation or a protrusion so that a complementary component rides the track. This is similar to tracks for a subway which may be protruding from the ground such as in the underground section or indented into the roadway such as above ground tracking.

Referring both to FIGS. 1 and 2, outer ring 5 has a ledge 21 with cut outs 11 and 19. Extending downwardly from ledge 21 and elaborated more with respect to FIG. 4 below, are elevational sections which maintain some friction between overcap 3 and outer ring 5. Thus, when a user rotates outer ring 5 without touching overcap 3, overcap 3 will travel with outer ring 5, in preferred embodiments, so as to maintain non-alignment and eliminate chance of alignment for removal of overcap 3 from outer ring 5.

Referring now to FIGS. 1 and 3, overcap 3 has a top 17 and a side wall 15 which includes protrusions 13 and 25. These are of adequate geometry so as to be able to fit into cut outs 11 and 19 of ledge 21 of outer ring 5. These protrusions 13 and 25 are opposite one another and of the same geometry but could be different in geometry or not directly opposite one another.

Also shown in FIG. 1 is a front view of spray mechanism 23 which includes spray nozzle tip 27 and a spray depressor 29. This is connected to main closure base 1 and extends downwardly therethrough so as to extend into container 51 (not shown) while spray mechanism 23 is shown to be a spray nozzle which may rely upon pressurized contents and depression for release thereof, it could very well be a pump, as shown in the Figure, or other known spray mechanisms such as an atomizer.

When overcap 3 is not atop the closure shown but is separate therefrom, in one embodiment, the protrusions 13 and 25 must be aligned with cut outs 11 and 19, inserted therein and then rotated to secure the overcap and render it child resistant. However, in an alternative and more preferred embodiment, ledge 21 and/or protrusions 13 and 25 have adequate flexibility so that overcap 3 may be pressed downwardly and, with the flexion of either the protrusion or the ledge 21, or both, overcap 3 will snap into place so that the protrusions 13 and 25 end up under ledge 21 or both, overcap 3 will snap into place so that the protrusions 13 and 25 end up under ledge 21 in a secure, child resistant fashion. The flexibility will be minimal such that the overcap 3 cannot then be removed, except by alignment of protrusions 13 and 25 with the cut outs 11 and 19.

FIG. 4 shows a front cut, partial view of overcap 3 and outer ring 5 from FIG. 1. Identical parts are identically numbered. Protrusions 43, e.g., downwardly extending bumps or triangular cross-sectioned extensions, are located on the underside of ledge 21 and similar protrusions 41 are located on the top side of protrusion 13. These nest when overcap 3 is snapped into outer ring 5 and enhance the overcap 3 and the outer ring 5, mentioned above, if either only the overcap 3 or only the outer ring 5 is rotated, the other will rotate with it and the non-alignment feature will be maintained. Thus, in preferred embodiments, a user can only remove overcap 3 by holding outer ring 5 with one hand and rotating overcap 3 with the other hand or vise versa so as to overcome the friction between the two and align the protrusions 13 and 25 with cut outs 11 and 19 for subsequent removal of the overcap 3 from the outer ring 5 to provide access to the spray mechanism 23.

FIG. 5 shows a top view of an outer ring 71 which may be used in an alternative embodiment closure of the present invention. Here, ledge 73 has cut outs 75 and 77 which are not directly opposite one another. This further restricts the removal of an overcap therefrom because, when two cut outs are opposite one another, there would be two opportunities or positions upon a 360° rotation, for removal of an overcap whereas, with the arrangement shown in FIG. 5, only one unique position will allow for proper alignment and removal of an overcap.

Obviously, numerous modifications and variations of the present invention are possible in light of the above teachings. It is therefore understood that within the scope of the appended claims, the invention may be practiced otherwise than as specifically described herein.

What is claimed is:

1. A spray dispenser device closure, which comprises:

(a) a main closure base for attachment to a container, said base having a top portion having a circular horizontal track thereon for attachment with an outer ring;

(b) an outer ring having a circular inside wall with a horizontal track thereon for attachment to the track of said base so as to connect said outer ring to said base so as to be horizontally and freely rotatable thereabout, said outer ring also having a top with an inwardly biased ledge for retaining an overcap, and having at least one cut out on said ledge to permit an overcap to be inserted and removed from said outer ring;

(c) a spray mechanism attached to the top of said base and extending therethrough for insertion into a container;

(d) an overcap having a circular bottom adapted to be inserted into said outer ring and over said spray mechanism, said bottom having at least one protrusion thereon which has a geometry of adequate size to freely move through said at least one cut out of said ledge of said outer ring and when said overcap is so inserted and rotated, of adequate size and geometry to prevent removal of said overcap from said outer ring, except when said at least one protrusion and said at least one cut out are in alignment; and, further wherein said outer ring ledge has an underside and said at least one protrusion of said overcap has a top wherein the underside of said ledge and the top side of said at least one protrusion are in frictional contact with one another when said overcap is inserted into said outer ring such that when one of said outer ring and said overcap are rotated, the other of said outer ring and said overcap rotates therewith, and wherein said frictional contact may be overcome manually by holding one of said outer ring and said overcap and rotating the other of said outer ring and said overcap.

2. The spray dispenser device closure of claim 1 wherein said main closure base has means for attachment to a container.

3. The spray dispenser device closure of claim 2 wherein said means for attachment is threading.

4. The spray dispenser device closure of claim 1 wherein said at least one cut-out comprises two cut-outs.

5. The spray dispenser device closure of claim 4 wherein said cut-outs are directly opposite one another.

6. The spray dispenser device closure of claim 4 wherein said cut-outs are not directly opposite one another.

7. The spray dispenser device closure of claim 1 wherein said underside of said ledge and said top of said at least one protrusion have non-smooth topographies to enhance said frictional contact.

8. The spray dispenser device closure of claim 1 wherein at least one of said ledge and said protrusions is downwardly flexible so as to permit insertion of said overcap without alignment of said at least one protrusion and said at least one cut out, and is upwardly inflexible so as to prevent removal of said overcap from said outer ring, except when said at least one protrusion and said at least one cut out are in alignment.

9. The spray dispenser device closure of claim 8 wherein said main closure base has means for attachment to a container.

10. The spray dispenser device closure of claim 9 wherein said means for attachment is threading.

11. The spray dispenser device closure of claim 8 wherein at least one cut-out comprises two cut-outs.

12. The spray dispenser device closure of claim 11 wherein said cut-outs are directly opposite one another.

13. The spray dispenser device closure of claim 11 wherein said cut-outs are not directly opposite one another.

14. The spray dispenser device closure of claim 8 wherein said underside of said ledge and said top of said at least one protrusion having non-smooth topographies to enhance said frictional contact.

* * * * *